US008210883B2

(12) United States Patent
Dennes

(10) Patent No.: US 8,210,883 B2
(45) Date of Patent: Jul. 3, 2012

(54) CONNECTOR BLOCK

(75) Inventor: Wayne William Dennes, Wyoming (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/978,081

(22) Filed: Dec. 23, 2010

(65) Prior Publication Data

US 2011/0159722 A1 Jun. 30, 2011

Related U.S. Application Data

(63) Continuation of application No. 12/374,968, filed as application No. PCT/EP2007/006366 on Jul. 18, 2007, now Pat. No. 7,901,254.

(30) Foreign Application Priority Data

Jul. 25, 2006 (AU) ..... 2006904009

(51) Int. Cl.
*H01R 9/22* (2006.01)

(52) U.S. Cl. ..... 439/709; 439/404

(58) Field of Classification Search ..... 439/404, 439/709–712, 715–719, 723–742, 941
See application file for complete search history.

(56) References Cited

U.S. PATENT DOCUMENTS

| | | | |
|---|---|---|---|
| 1,633,971 | A | 6/1927 | Baxter |
| 2,983,897 | A | 5/1961 | Blanchet |
| RE25,442 | E | 9/1963 | Blanchet |
| 3,123,425 | A | 3/1964 | Blanchert |
| 3,245,029 | A | 4/1966 | Piperato |
| 3,689,865 | A | 9/1972 | Pierini et al. |
| 4,144,554 | A | 3/1979 | Erickson |
| 4,281,885 | A | 8/1981 | Forberg et al. |
| 4,405,187 | A | 9/1983 | Muller et al. |
| 4,452,502 | A | 6/1984 | Forberg et al. |
| 4,541,682 | A | 9/1985 | Gerke et al. |
| 4,581,489 | A | 4/1986 | Nozick |
| 4,685,755 | A | 8/1987 | Pitsch |

(Continued)

FOREIGN PATENT DOCUMENTS

| | | |
|---|---|---|
| AU | 42651/85 | 11/1985 |

(Continued)

OTHER PUBLICATIONS

New Zealand Office Action for corresponding application No. 572640 dated Jul. 28, 2010.

(Continued)

*Primary Examiner* — Thanh Tam Le
(74) *Attorney, Agent, or Firm* — Merchant & Gould P.C.

(57) ABSTRACT

The invention relates to a connector block (11) for separating insulated conductors of a first data cable (82) and a second data cable (86), said connector block containing: first and second groups (12A, 14A) of a plurality of slits (16) arranged in a row along a common side of the connector block; and a plurality of insulation displacement contacts comprising forked contact sections (21, 23) which at least partially extend into respective individual slits in order to electrically separate the insulated conductors. The groups of slits are separated by an insulation space (22) in order to reduce alien crosstalk between the conductors of the first data cable (82), which are coupled to the insulation displacement contacts of the first group of slits (12A), and the conductors of the second data cable (86), which are coupled to the insulation displacement contacts of the second group of slits (14A).

9 Claims, 7 Drawing Sheets

U.S. PATENT DOCUMENTS

| | | | | |
|---|---|---|---|---|
| 4,741,711 | A | 5/1988 | Singer, Jr. | |
| 4,846,735 | A | 7/1989 | Teichler et al. | |
| 4,851,967 | A | 7/1989 | Gerke et al. | |
| 4,871,330 | A | 10/1989 | Muller et al. | |
| 4,986,768 | A | 1/1991 | Bramkamp et al. | |
| 5,000,703 | A | 3/1991 | Biederstedt et al. | |
| 5,044,979 | A | 9/1991 | Siemon et al. | |
| 5,114,356 | A | 5/1992 | Taybl et al. | |
| 5,160,273 | A | 11/1992 | Carney | |
| 5,160,274 | A | 11/1992 | Ozaki et al. | |
| 5,186,647 | A | 2/1993 | Denkmann et al. | |
| 5,226,835 | A | 7/1993 | Baker, III et al. | |
| 5,297,975 | A | 3/1994 | Gerke et al. | |
| 5,459,643 | A | 10/1995 | Siemon et al. | |
| 5,494,461 | A | 2/1996 | Bippus et al. | |
| 5,501,617 | A | 3/1996 | Arnett | |
| 5,700,167 | A | 12/1997 | Pharney et al. | |
| 5,800,187 | A | 9/1998 | Vermon et al. | |
| D399,490 | S | 10/1998 | Gerke et al. | |
| D408,013 | S | 4/1999 | Zimmer et al. | |
| D409,178 | S | 5/1999 | Klinker | |
| 5,911,602 | A | 6/1999 | Vaden | |
| 6,086,428 | A | 7/2000 | Pharney et al. | |
| 6,284,980 | B1 | 9/2001 | Filus et al. | |
| 6,319,069 | B1 | 11/2001 | Gwiazdowski | |
| 6,334,792 | B1 | 1/2002 | Schmidt et al. | |
| 6,336,826 | B1 | 1/2002 | Kraft | |
| 6,344,792 | B1 | 2/2002 | Tuttle et al. | |
| D460,419 | S | 7/2002 | Zielke et al. | |
| 6,755,678 | B2 | 6/2004 | Ward et al. | |
| 6,837,737 | B2 | 1/2005 | Baier et al. | |
| 7,037,118 | B2 | 5/2006 | Neumetzler | |
| 7,311,550 | B2 * | 12/2007 | Hammond et al. | 439/540.1 |
| D575,743 | S | 8/2008 | Shifris et al. | |
| 7,614,901 | B1 | 11/2009 | Siev et al. | |
| D607,822 | S | 1/2010 | Dennes | |
| 2002/0049000 | A1 | 4/2002 | Tanaka et al. | |
| 2005/0186838 | A1 | 8/2005 | Debenedictis et al. | |
| 2005/0186844 | A1 | 8/2005 | Hammond, Jr. et al. | |
| 2005/0221677 | A1 | 10/2005 | Hammond, Jr. et al. | |
| 2005/0221678 | A1 | 10/2005 | Hammond, Jr. | |
| 2007/0184725 | A1 | 8/2007 | Hashim | |
| 2008/0113561 | A1 | 5/2008 | Hammond, Jr. et al. | |
| 2008/0227340 | A1 | 9/2008 | Debenedictis et al. | |
| 2008/0254672 | A1 | 10/2008 | Dennes et al. | |
| 2009/0325426 | A1 | 12/2009 | Dennes | |

FOREIGN PATENT DOCUMENTS

| | | |
|---|---|---|
| AU | 74643/87 | 1/1988 |
| AU | 16987/88 | 2/1989 |
| DE | 1909786 | 10/1969 |
| DE | 2811812 | 11/1979 |
| DE | 2846948 | 5/1980 |
| DE | 8220267 | 10/1982 |
| DE | 3621223 | 1/1988 |
| DE | 4127896 | 2/1993 |
| DE | 199 25 654 | 12/2000 |
| DE | 103 41 694 | 2/2005 |
| EP | 0133824 | 3/1985 |
| EP | 0141957 | 5/1985 |
| EP | 0382322 | 8/1990 |
| EP | 0304393 | 1/1994 |
| EP | 0 637 097 | 2/1995 |
| GB | 1345178 | 1/1974 |
| GB | 1359732 | 7/1974 |
| GB | 2013423 | 8/1979 |
| GB | 2017428 | 10/1979 |
| GB | 2019129 | 10/1979 |
| GB | 1594324 | 7/1981 |
| GB | 2 350 944 | 12/2000 |
| NZ | 280334 | 2/1997 |
| PL | 164907 | 10/1994 |
| WO | WO 2006/120373 | 11/2006 |
| WO | WO2008/012016 | 1/2008 |
| WO | WO 2008/012017 | 1/2008 |

OTHER PUBLICATIONS

Notice of Allowance mailed Aug. 19, 2010 in copending and coassigned U.S. Appl. No. 12/374,962.

"Business Communication Networks," *Quante*, 5 pages (1999/2000).

"Connections," R&M, 2 pages (Publically known at least as early as Jun. 19, 2009).

"Gesamtkatalog_Datenvernetzung," EFB Elektinik, vol. 1, 2 pages (2008).

Moeller, F et al., Grundlagen der Elektrotechnik, pp. 158-165 (1967).

* cited by examiner

CONNECTOR BLOCK

This application is Continuation of U.S. Ser. No. 12/374,968, filed 23 Jan. 2009, now U.S. Pat. No. 7,901,254, which is a National Stage Application of PCT/EP2007/006366, filed 18 Jul. 2007, which claims benefit of Serial No. 2006904009, filed 25 Jul. 2006 in Australia and which applications are incorporated herein by reference. To the extent appropriate, a claim of priority is made to each of the above disclosed applications.

TECHNICAL FIELD

The present invention relates to a connector block for terminating a plurality of insulated conductors of two or more electronic data cables.

BACKGROUND

When cables are formed from multiple twisted pair conductors, electromagnetic coupling between pairs, also referred to as crosstalk (XT), can be reduced by each pair having different twist rates. However, when similar cables are adjacent, twisted pairs may be placed very close to other twisted pairs with the same twist rate, which increases the crosstalk between twisted pairs with matching twist rates in adjacent cables; crosstalk between cables is also referred to as alien crosstalk (AXT).

Connector blocks (also known as terminator blocks) are useful for terminating and joining many pairs of conductors simultaneously. Current conductor blocks may be hampered by unwanted electromagnetic coupling between conductors. This may be particularly the case at high frequencies and when multiple cables, each containing several conductors, are packed tightly together. This unwanted electromagnetic coupling may also include alien crosstalk.

It is generally desirable to overcome one or more of the above-described difficulties, or at least provide a useful alternative.

SUMMARY

In accordance with one aspect of the present invention, there is provided a connector block for terminating insulated conductors of a first data cable and a second data cable, including:

(a) a plurality of slots arranged in series along a common side of the connector block in first and second groups; and (b) a plurality of insulation displacement contacts having bifurcated contact portions at least partially extending into respective ones of said slots for terminating the insulated conductors, wherein the groups are separated by an isolation gap to reduce alien crosstalk between the conductors of the first data cable coupled to the insulation displacement contacts of the first group of slots and the conductors of the second data cable coupled to the insulation displacement contacts of the second group of slots.

Preferably, the conductors of the first data cable and the second data cable are arranged in twisted pairs, and the slots are arranged in pairs for receiving the conductors of corresponding twisted pairs.

Preferably, the isolation gap is greater than the distance between adjacent pairs of slots.

Preferably, the distance between adjacent pairs of slots is greater than the distance between the slots of one of said pairs of slots.

Preferably, the isolation gap is greater than 17 mm.

In accordance with one aspect of the present invention, there is provided a method of terminating a plurality of insulated conductors of first and second electronic data cables using the connector block disclosed herein, the insulated conductors of each cable of said cables arranged in twisted pairs, including the steps of:

(a) terminating a first twisted pair of the first cable having a first twist rate in a first pairs of slots of a first group of slots; and (b) terminating a first twisted pair of the second cable having substantially said first twist rate in a first pair of slots of a second group of slots, wherein the position of the first pair of slots of the second group corresponds to the position of the first pair of slots of the first group of slots.

Preferably, steps (a) and (b) are repeated for second and third and fourth twisted pairs of the first and second cables.

BRIEF DESCRIPTION OF THE DRAWINGS

Preferred embodiments of the invention are hereinafter described, by way of non-limiting example only, with reference to the accompanying drawings, in which.

DETAILED DESCRIPTION

Figure 1:
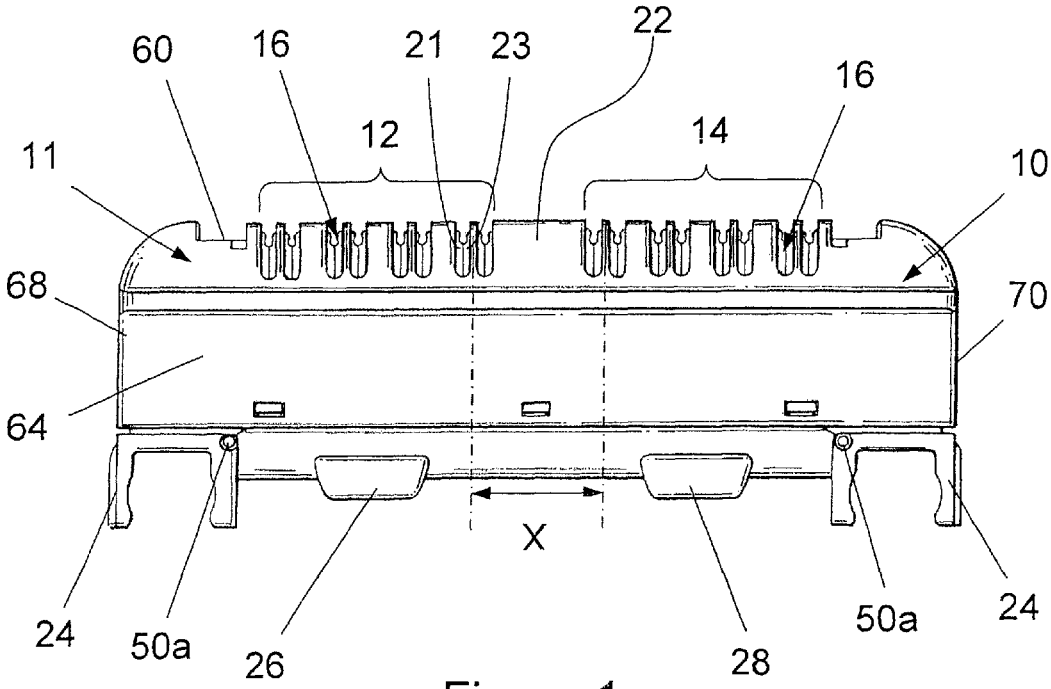
FIG. 1 is a top view of a connector block.
Figure 2:
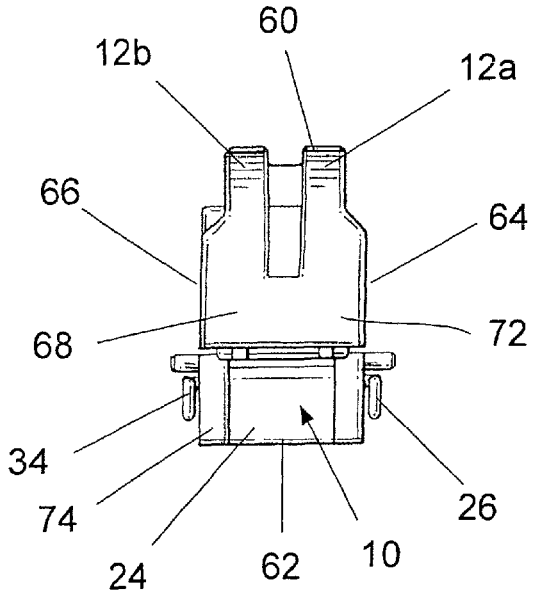
FIG. 2 is a first end view of the connector block shown in FIG. 1.
Figure 3:
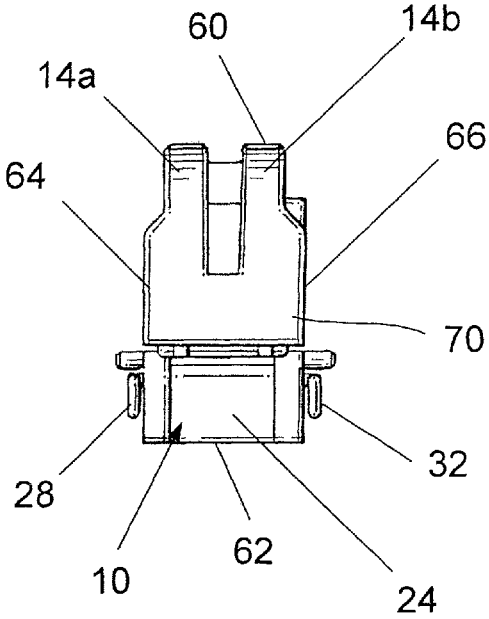
FIG. 3 is a second end view of the connector block shown in FIG. 1.

The connector block 10 shown in FIGS. 1 to 7 is used to terminate the insulated conductors of four data cables (not shown). The connector block 10 includes a generally rectangular housing 11 having a front side 60; a back side 62; a top side 64; and a bottom side 66. The housing 11 is elongated along a length that extends from a first end 68 to a second end 70. The housing 11 preferably includes a front piece 72 that connects to a base piece 74. In one embodiment, the front piece 72 is connected to the base piece 74 by a snap-fit connection. It will be appreciated that the front piece 72 defines the front side 60 of the housing 11 and the base piece 74 defines the back side 62 of the housing 11.

As particularly shown in FIG. 1, the connector block 10 includes two adjacent groups 12, 14 of insulation displacement contact slots 16. Each group 12, 14 of slots 16 is arranged in two rows 12*a*, 12*b*, and 14*a*, 14*b* that extend side by side along the front side 60 of the housing 11 in the manner shown in FIG. 4. In the described arrangement, the rows 12*a* and 14*a* of slots extend along the front side 60 of the housing 11 in a line adjacent to the top side 64 of the housing 11.

Similarly, the rows 12*b* and 14*b* of slots extend along the front side 60 of the housing 11 in a line adjacent to the bottom side 66 of the housing 11.

Figure 4:
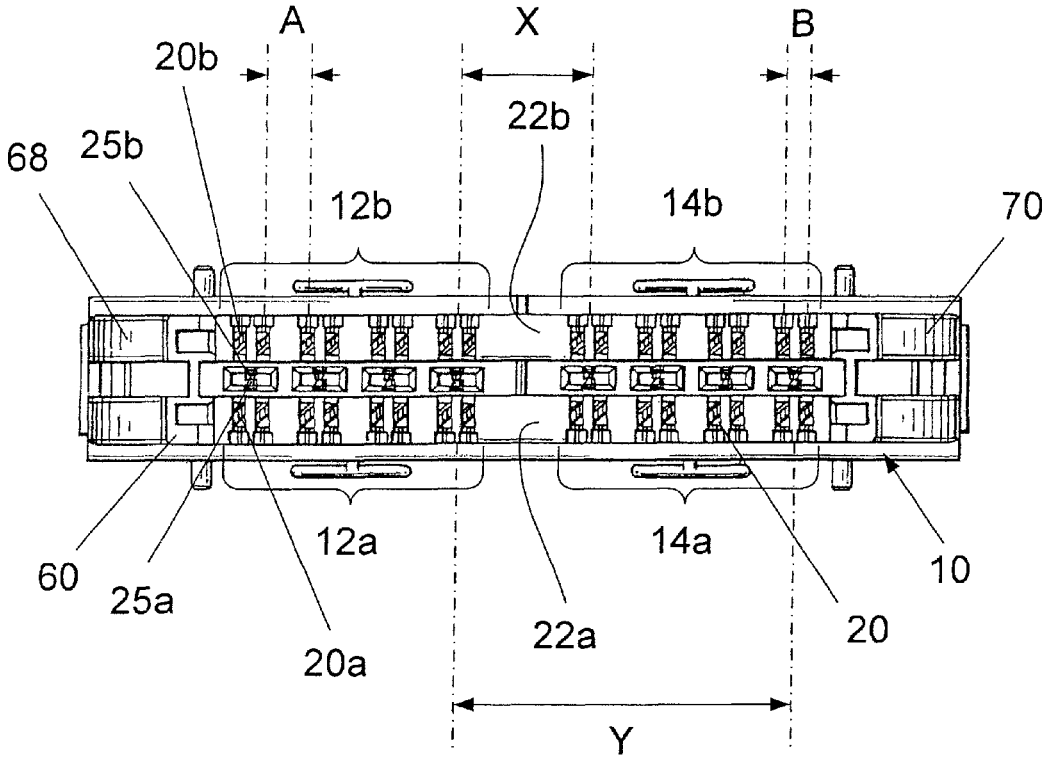
FIG. 4 is a front view of the connector block shown in FIG. 1.
Figure 5:
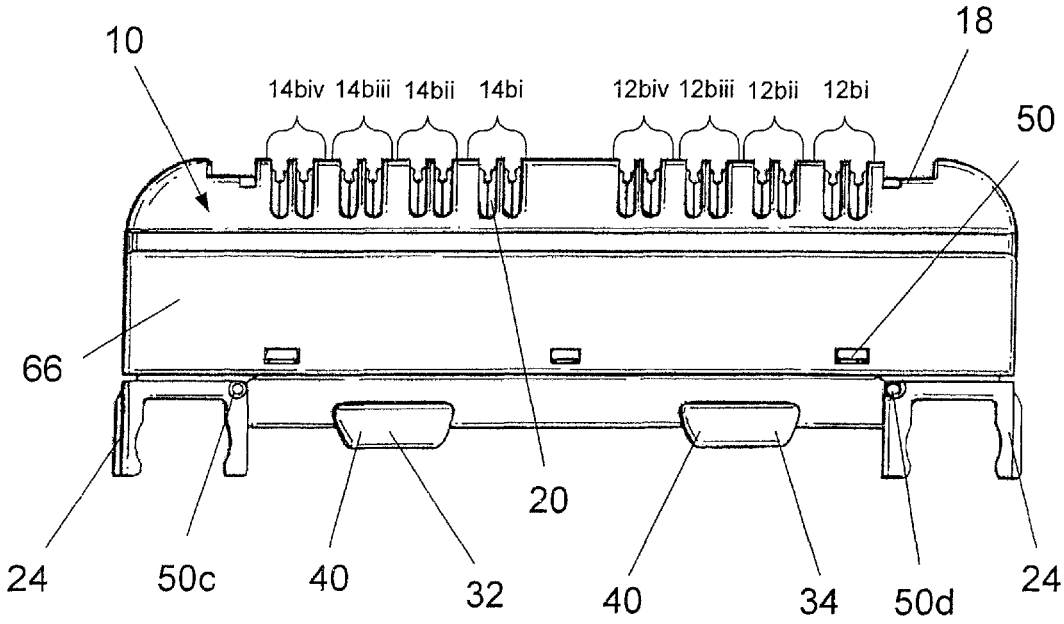
FIG. 5 is a bottom view of the connector block shown in FIG. 1.

As particularly shown in FIGS. 4 and 5, the connector block 10 includes a plurality of insulation displacement contacts (IDCs) 20 captured between the front piece 72 and the base piece 74. Each IDC 20 is preferably formed from a contact element which is bifurcated so as to define two opposed contact portions 21, 23 separated by a slot into which an insulated wire may be pressed so that edges of the contact portions engage and displace the insulation and such that the contact portions resiliently engage and make electrical connection with the conductor of the insulated wire. The described IDCs 20 are taught by U.S. Pat. No. 4,452,502 and U.S. Pat. No. 4,405,187, for example. The two opposed contact portions 21, 23 of the IDCs 20 are laid open in corresponding slots 16 of front piece 74 of the housing 11 in the manner shown in FIG. 1, for example.

The IDCs 20 are arranged in fixed positions with respect to the insulation displacement contact slot 16 such that the contact portions 21, 23 of each IDC 20 extend into a corresponding slot 16. As particularly shown in FIG. 8, each slot of the first row 12*a* slots is adapted to receive an end portion of a corresponding insulated conductor 80 of a first data cable 82. The end portion of each insulated conductor 80 can be electrically connected to a corresponding IDC by pressing the end portion of the conductor 80 between the opposed contact portions 21, 23. Similarly, each slot of the second row 14*a* slots 16 is adapted to receive an end portion of a corresponding insulated conductor 84 of a second data cable 86. The end portion of each insulated conductor 84 can be electrically connected to a corresponding IDC 20 by pressing the end portion of the conductor 84 between the opposed contact portions 21, 23. Insulated conductors of other data cables (not shown) can also be electrically connected, in the above described manner, to respective ones of the IDCs 20 of the second row 12*b* of the first group 12 of slots 16, and to respective ones of the IDCs 20 of the second row 14*b* of the second group 14 of slots 16.

The IDCs 20*a* of the first row of slots 12*a* are electrically connected to respective ones of the IDCs 20*b* of the second row of slots 12*b* by spring finger contacts 25*a*, 25*b* extending therebetween. Accordingly, the insulated conductors 80 of the first data cable 82 that are electrically connected to the IDCs 20*a* of the first row 12*a* of slots 16 are electrically connected to respective ones of the insulated conductors of another data cable (not shown) electrically connected to the IDCs 20*b* of the row 12*b* of slots 16. Similarly, the insulated conductors 84 of the second data cable 86 that are electrically connected to the IDCs 20*a* of the row 14*a* of slots 16 are electrically connected to respective ones of the insulated conductors of yet another data cable (not shown) electrically connected to the insulation displacement contacts 20*b* of the row 14*b* of slots 16. An example of the described arrangement of slots 16 and IDCs 20 of the connector block 10 is set out in U.S. Pat. No. 4,541,682.

Importantly, the connector block 10 is designed to reduce alien crosstalk between the first and second data cables 80, 86 when they are electrically connected to the IDCs 20 of the rows 12*a*, 14*b* of the first and second groups 12, 14 of slots 16. Alien crosstalk is reduced by separating the rows 12*a*, 14*a* with an isolation gap 22*a*. Similarly, the connector block 10 is designed to reduce alien crosstalk between data cables electrically connected to the IDCs 20 of the rows 12*b*, 14*b* of the first and second groups of slots 16 by separating the rows 12*b*, 14*b* with an isolation gap 22*b*. The isolation gap 22 is, for example, greater than 17 mm.

Figure 8:
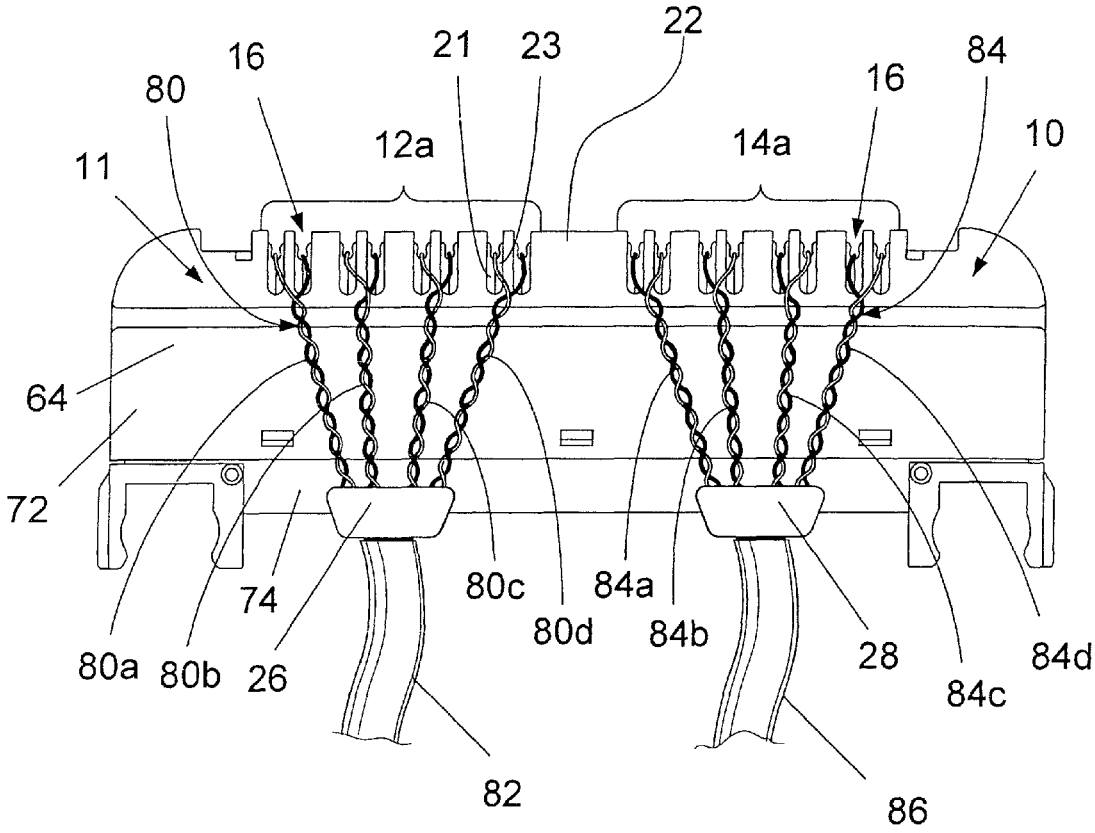
FIG. 8 is a top view of the connector block shown in FIG. 1 coupled to the insulated conductors of two data cables.

As particularly shown in FIG. 8, the isolation gap 22 is selected to reduce alien crosstalk between neighbouring cables 82, 86 by increasing the distance "X" between centres of twisted pairs of adjacent groups 12, 14 of slots 16. The isolation gap 22 is, for example, greater than 17 mm. Advantageously, the isolation gap 22 reduces alien crosstalk to a level that renders the connector block 10 suitable for use in an installation compliant with the Category 6 communications standard, and other high bandwidth communications standards such as 10 gigabyte.

The length "X" of isolation gap 22 is preferably selected to be as large as possible given the space requirements of the insulation displacement contacts 20. The length "X" of isolation gap 22 is preferably selected to be as large as possible given the space constraints of the apparatus in which the connector block 10 is to be mounted. For example, where the mounting apparatus is a communications rack or a configuration of mounting bars.

As particularly shown in FIG. 8, the insulated conductors 80, 84 of the first and second data cables 82, 86 are arranged in twisted pairs. The twisted pairs of each data cable 82, 86 have different twist rates. An example of such a cable is a Category 6 cable manufactured by ADC Communications Pty Ltd. It is to be appreciated, however, that other embodiments of the present invention may accommodate cables that include more or fewer twisted pairs of conductors, for example.

Figure 7:
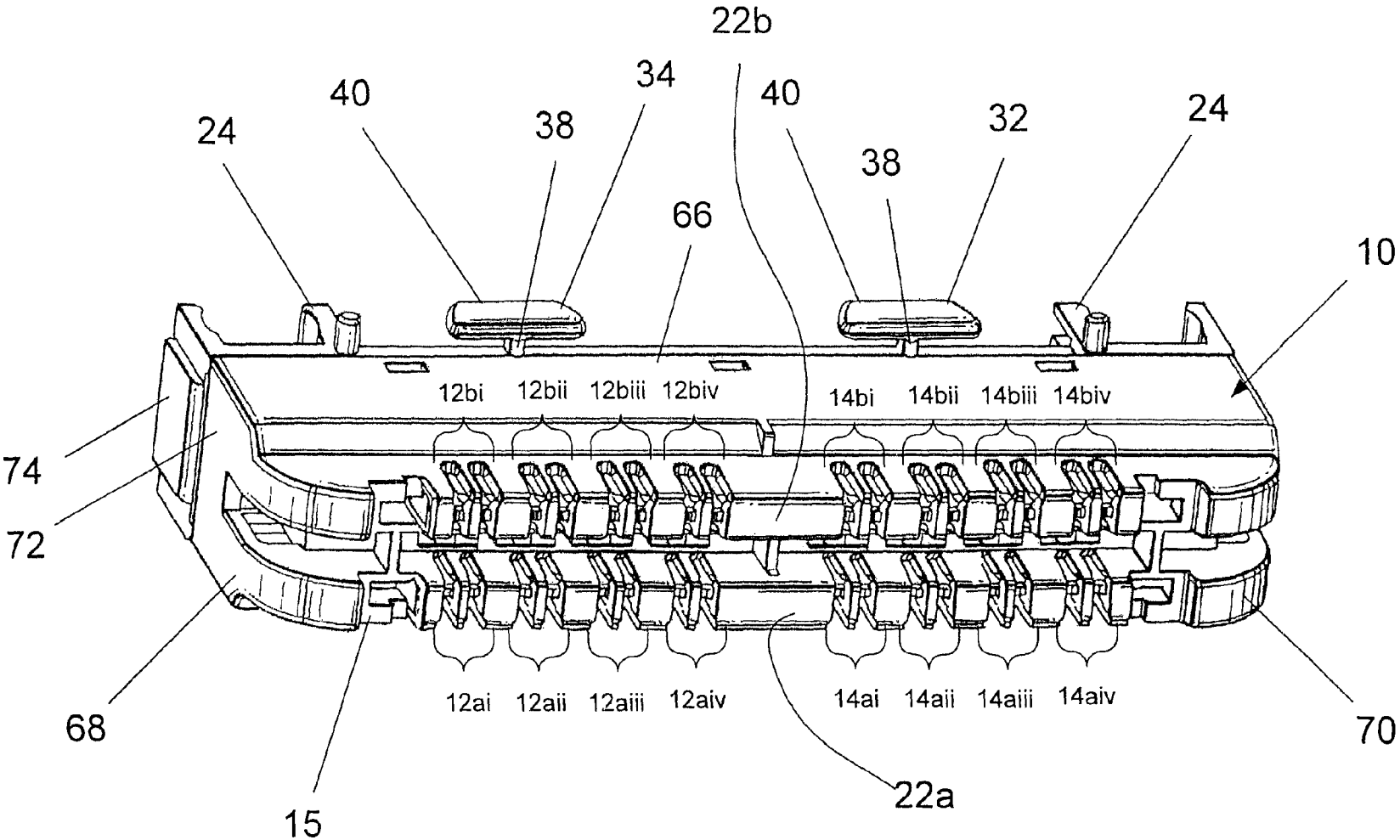
FIG. 7 is a perspective view of the connector block shown in FIG. 1.

As particularly shown in FIG. 7, the insulation displacement contact slots 16 of each row 12*a*, 12*b*, 14*a*, 14*b* of slots 16 are arranged in the following pairs:

1. 12*ai*, 12*aii*, 12*aiii*, 12*aiv;*
2. 12*bi*, 12*bii*, 12*biii*, 12*biv;*
3. 14*ai*, 14*aii*, 14*aiii*, 14*aiv*; and
4. 14*bi*, 14*bii*, 14*biii*, 14*biv.*

The connector block 10 is used to terminate the conductors 80 of the four twisted pairs 80*a*, 80*b*, 80*c*, 80*d* of the first cable 82 in corresponding slot pairs 12*ai*, 12*aii*, 12*aiii* and 12*aiv* of the first row 12*a* of slots 16 in the manner shown in FIG. 8. Advantageously, the twisted pair 80*a* terminated at location 12*ai* has a first twist rate; the twisted pair 80*b* terminated at location 12*aii* has a second twist rate; the twisted pair 80*c* to be terminated in location 12*aiii* has a third twist rate; and the twisted pair 80*d* to be terminated in location 12*aiv* has a fourth twist rate. The connector block 10 is also used to terminate four twisted pairs 84*a*, 84*b*, 84*c*, 84*d* from the second cable 86 in corresponding slot pairs 14*ai*, 14*aii*, 14*aiii*, 14*aiv* in a similar manner. Advantageously, the twisted pairs of said second cable 84 are arranged such that the twisted pair 84*a* terminated at location 14*ai* has a first twist rate; the twisted pair 84*b* terminated at location 14*aii* has a second twist rate; the twisted pair 84*c* terminated at location 14*aiii* has a third twist rate; and the twisted pair 84*d* terminated at location 14*aiv* has a fourth twist rate. The described arrangement of twisted pairs of the first and second cables 82, 86 advantageously provides a minimum separation distance of 17 mm between the closest centre distance of twisted pairs in adjacent cables, thereby minimising alien crosstalk.

Advantageously, twisted pairs of the two adjacent cables 82, 86 are terminated in the connector block 10 in the following manner:

a. The first twist rate of the twisted pair 80*a* terminated at the slot pair 12*ai* matches the first twist rate of the twisted pair 84*a* terminated at the slot pair 14*ai.*
b. The second twist rate of the twisted pair 80*b* terminated at the slot pair 12*aii* matches the second twist rate of the twisted pair 84*b* terminated at the slot pair 14*aii.* c. The third twist rate of the twisted pair 80*c* terminated at the slot pair 12*aiii* matches the third twist rate of the twisted pair 84*c* terminated at the slot pair 14*aiii*.

d. The fourth twist rate of the twisted pair 80*d* terminated at the slot pair 12*aiv* matches the fourth twist rate of the twisted pair 84*d* terminated at the slot pair 14*aiv*.

Twisted pairs of the two adjacent cables 82, 86 having common twist rates are arranged in slot pairs that provide maximum distance "Y", as shown in FIG. 4, therebetween. The length "X" of the isolation gap 22*a* is preferably greater than 17 mm. Advantageously, the isolation gap 22*a* reduces alien crosstalk to a level that renders the connector block 10 suitable for use in an installation compliant with the Category 6 communications standard and other high bandwidth communications standards.

Similarly, the connector block 10 is used to terminate four twisted pairs from a third cable (not shown) in the slot pairs 12*bi*, 12*bii*, 12*biii* and 12*biv* and from a fourth cable (not shown) in the slot pairs 14*bi*, 14*bii*, 14*biii* and 14*biv*. Advantageously, twisted pairs of the two adjacent cables are terminated in the connector block 10 in the following manner:

a. The first twist rate of the twisted pair terminated at the slot pair 12*bi* matches the first twist rate of the twisted pair terminated at the slot pair 14*bi*.

b. The second twist rate of the twisted pair terminated at the slot pair 12*bii* matches the second twist rate of the twisted pair terminated at the slot pair 14*bii*.

c. The third twist rate of the twisted pair terminated at the slot pair 12*biii* matches the third twist rate of the twisted pair terminated at the slot pair 14*biii*.

d. The fourth twist rate of the twisted pair terminated at the slot pair 12*biv* matches the fourth twist rate of the twisted pair terminated at the slot pair 14*biv*.

Twisted pairs of adjacent third and fourth cables having common twist rates are arranged in slots that provide maximum distance "Y", as shown in FIG. 4, therebetween. The length "X" of the isolation gap 22*b* is preferably greater than 17 mm. Advantageously, the isolation gap 22*b* reduces alien crosstalk to a level that renders the connector block 10 suitable for use in an installation compliant with the Category 6 communications standard and other high bandwidth communications standards.

As particularly shown in FIG. 4, the distance "A" between closest centres of slots 16 of adjacent twisted pairs is preferably 5.5 mm. The distance "B" between closest centres of slots 16 for twisted pairs is preferably 3 mm. The distance "A" is preferably greater than the distance "B".

The connector block 10 includes clips 24 for coupling the connector block to a rack mounting structure, such as, for example, a pair of fixed bars which are gripped by clips 24. The connector block 10 could alternatively be secured to a mounting structure by any other suitable means. The clips 24 are located on the back side 62 of the connector block 10 and are connected to the base piece 74.

Figure 6:
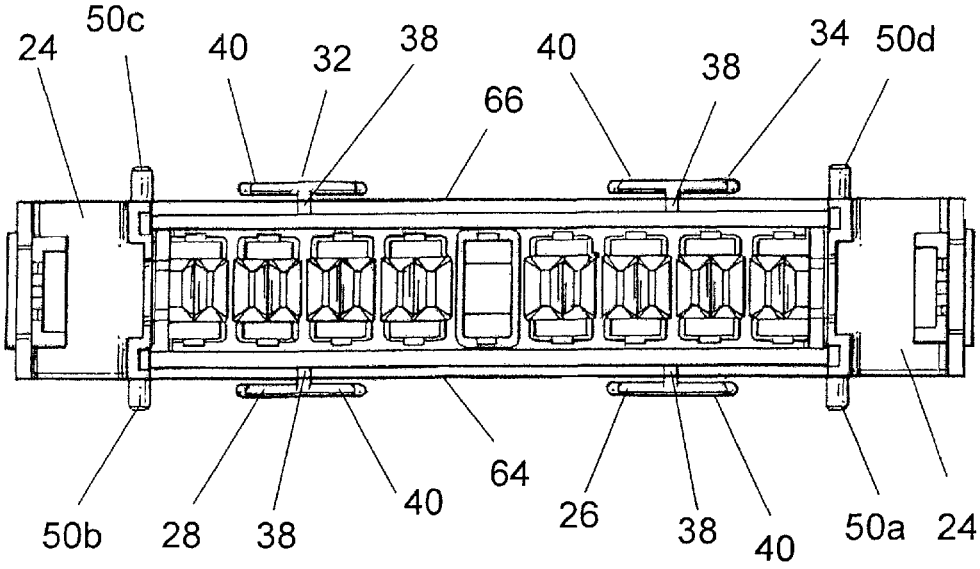
FIG. 6 is a back view of the connector block shown in FIG. 1.

As particularly shown in FIG. 6, the connector block 10 also includes first and second cable managers 26, 28 positioned on the top side 64 of base piece 74 of the housing 11 for locating cables in fixed positions for presentation to respective ones of rows 12*a* and 14*a* of slots 16. The connector block 10 also includes third and fourth cable managers 32, 34 positioned on the bottom side 66 of the base piece 74 of the housing 11 for locating cables in fixed positions for presentation to respective ones of rows 12*b* and 14*b* of slots 16.

Each cable manager 26, 28, 32, 34 includes a lug 38 that extends outwardly from its respective side 30, 36 of the housing 11. Distal ends of the lugs 38 include flanges 40 that extend generally parallel to respective sides 30, 36 of the housing 11. The cable managers 26, 28, 32, 34 are generally "T" shaped. The distance between the flanges 40 and the respective sides 30, 36 of the housing 11 is preferably less than the width of the data cables 82, 86 and more than the width of the of conductors 80, 84.

As particularly shown in FIG. 8, the first cable manager 26 is coupled to the top side 64 of the base piece 74 between slot pairs 12*aii* and 12*aiii*. The first cable manager 26, for example, is designed to sit between the second and third twisted pairs 80*b*, 80*c* of the first cable 82. When so arranged, the lug 38 is located in a "V" formed between the second and third twisted pairs 80*b*, 80*c* and the sheath of the cable 82. In this position the end of the sheath abuts the flange 40 or the lug 38. In either case, the cable manager 26 holds the end of cable 82 in a fixed position once the ends of the conductors 80 are terminated in corresponding slots 16. In the described arrangement, the cable manager 26 holds the cable 82 flush against the top side 64 of the housing 11. Where a plurality of connector blocks 10 are stacked on top of one another, for example, the cable manager 26 prevents interference between the cables.

In the described arrangement, the length of the first twisted pair 80*a* is preferably the same as the fourth twisted pair 80*d*. Similarly, the length of the second twisted pair 80*b* is preferably the same as the third twisted pair 80*c*.

Similarly, the second cable manager 28 is coupled to the top side 64 of the base piece 74 between slot pairs 14*aii* and 14*aiii*. The second cable manager 28 is designed to sit between the second and third twisted pairs 84*b*, 84*c* of the second cable 86. When so arranged, the lug 38 is located in a "V" formed between the second and third twisted pairs 84*b*, 84*c* and the sheath of the cable 86. In this position the end of the sheath abuts the flange 40 or the lug 38. In either case, the cable manager 28 holds the end of cable 86 in a fixed position once the ends of the conductors 84 are terminated in corresponding slots 16. In the described arrangement, the cable manager 28 holds the conductors 84 flush against the top side 64 of the housing 11.

In the described arrangement, the length of the first twisted pair 84*a* is preferably the same as the fourth twisted pair 84*d*. Similarly, the length of the second twisted pair 84*b* is preferably the same as the third twisted pair 84*c*.

The third and fourth cable managers are coupled to the bottom side 66 of the base piece 74 respectively between slot pairs 12*bii* and 12*biii*, and slot pairs 14*bii* and 14*biii*. The arrangement of the third and fourth cable managers 32, 34 is analogous to that of the first and second cable managers 26, 28 and is not described here in further detail.

The flanges 40 are of sufficient size and width to prevent the twisted pairs being dislocated by cable movement. Where a plurality of connector blocks 10 are stacked on top of one another, for example, the cable managers 26, 28, 32, 34 prevent interference between the cables.

The cable managers 26, 28, 32, 34 are preferably formed integrally with the connector block 10. Alternatively, the cable managers 26, 28, 32, 34 are attached to the body of the connector block 10 at a later point.

As particularly shown in FIG. 6, the connector block 10 also includes top spacers 50*a*, 50*b* coupled to the top side 64 of the base piece 74 of the housing 11. The connector block 10 also includes bottom spacers 50*c*, 50*d* coupled to the bottom side 66 of the base piece 74 of the housing 11. Where a plurality of connector blocks 10 are stacked one on top of the other, the bottom spacers 50*c*, 50*d* of one connector block 10 rest on the top spacers 50*a*, 50*b* of the connector block 10 immediately below. The spacers 50*a*, 50*b*, 50*c*, 50*d* thereby separate the connector blocks 10 in the stack. The spacers

50*a*, 50*b*, 50*c*, 50*d* separate the connector blocks in the stack by a minimum distance to prevent significant interference between the conductors of adjacent cables coupled to adjacent connector blocks 10. The spacers 50*a*, 50*b*, 50*c*, 50*d* preferably prevent alien crosstalk between the conductors of adjacent cables coupled to adjacent connector blocks 10.

Figure 9:
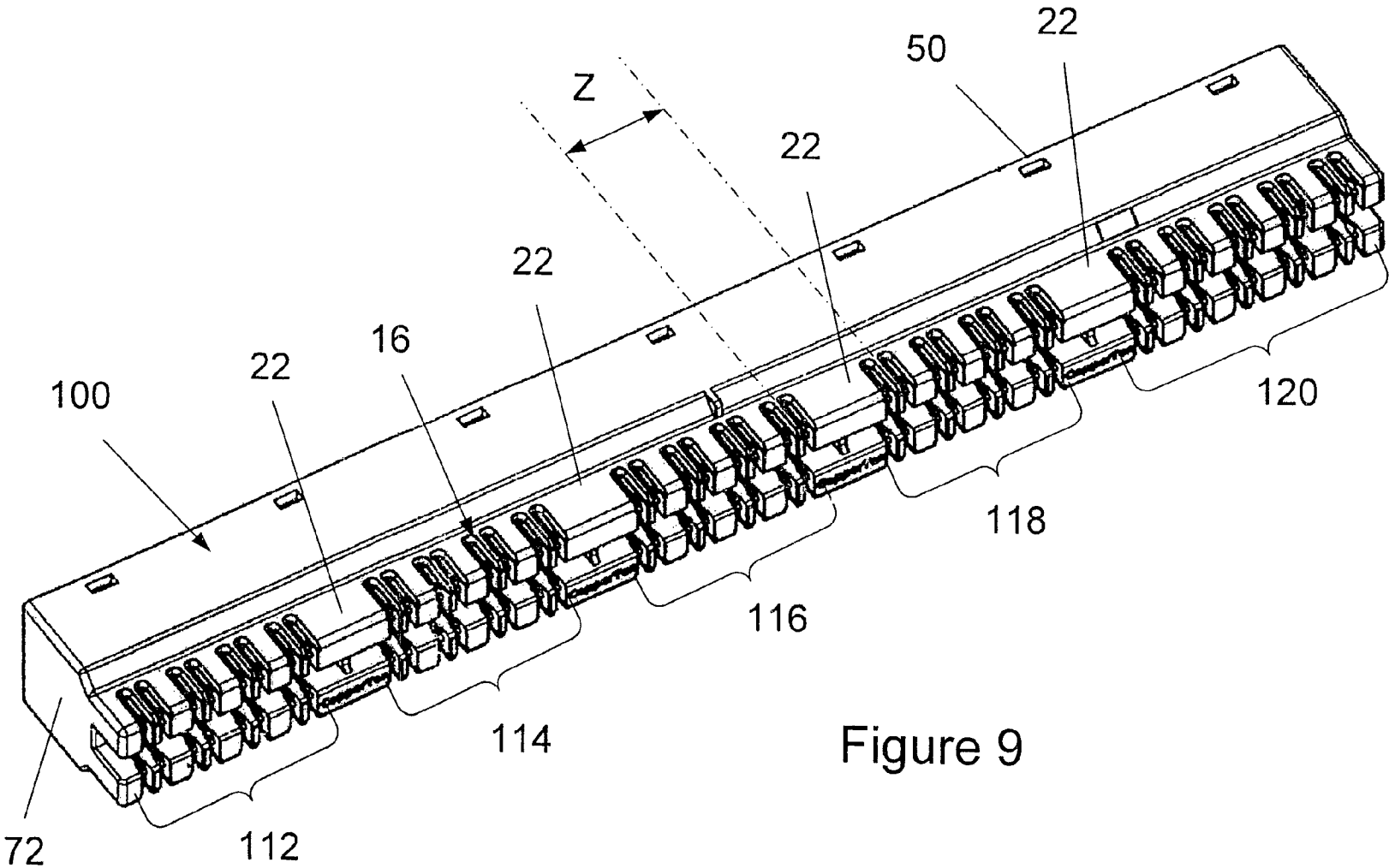
FIG. 9 is a perspective view of a front piece of another connector block including a plurality of insulation displacement contacts coupled thereto.
Figure 10:
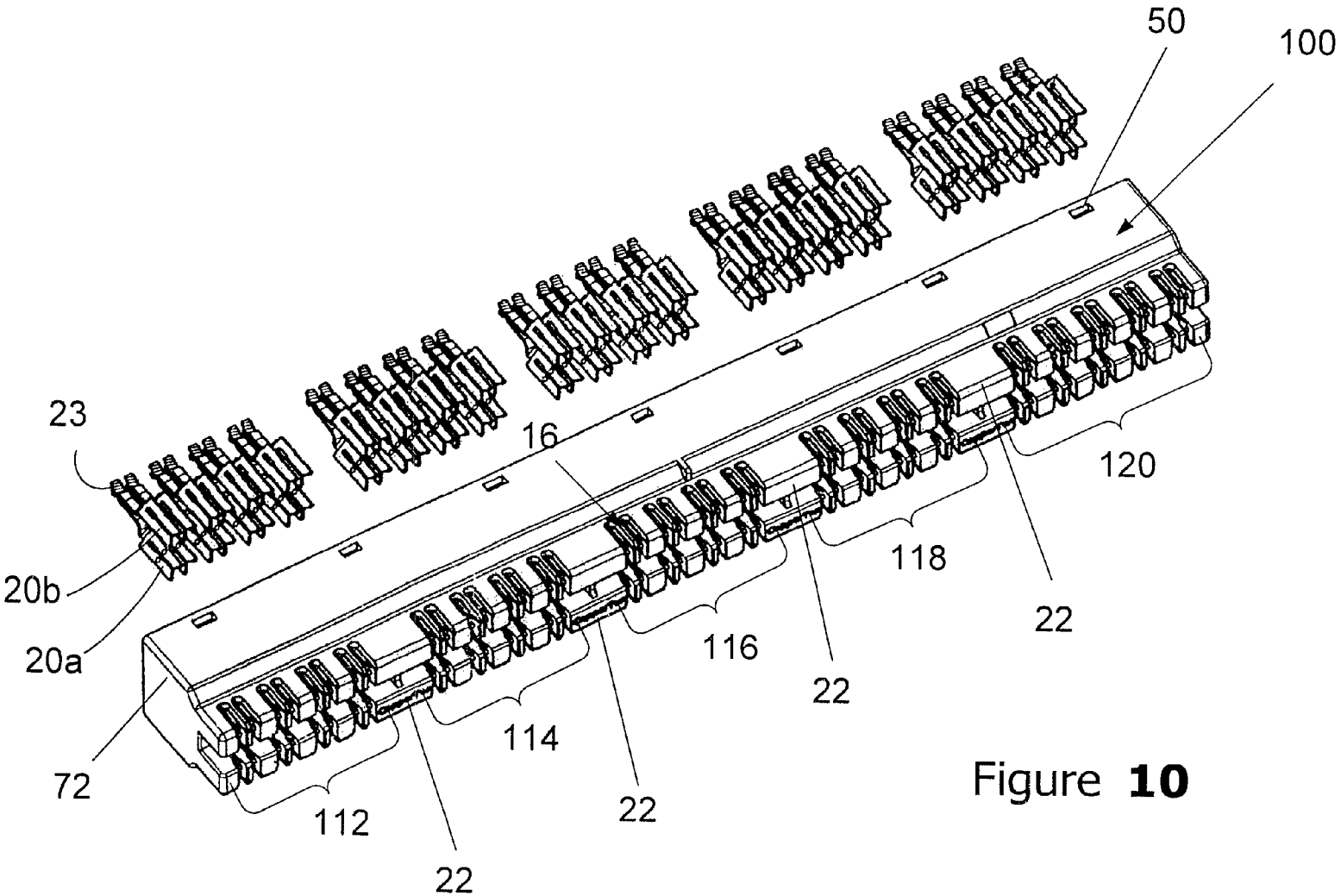
FIG. 10 is an exploded view of the front piece of the connector block shown in FIG. 9.

The connector block 100 shown in FIGS. 8 and 9 is used to terminate the insulated conductors of ten data cables (not shown). The connector block 100 includes five adjacent groups 112, 114, 116, 118, 120 of insulation displacement contact slots 16. The connector block 100 functions in an analogous manner to that of the connector block 10 and, as such, reference numerals for common parts are the same. The connector block 100 is designed to reduce alien crosstalk, for example, by including isolation gaps 22 between adjacent groups 112, 114, 116, 118, 120 of insulation displacement contact slots 16. Advantageously, the isolation gap 22 reduces alien crosstalk to a level that renders the connector block 100 suitable for use in an installation compliant with the Category 6 communications standard and other high bandwidth communications standards.

The length "X" of the isolation gaps is selected to reduce alien crosstalk between neighbouring data cables (not shown) by increasing the distance between the slots 16 corresponding to neighbouring cables. The isolation gap 22 preferably increases the distance between slots for twisted pairs of equal twist rates.

The length "X" of isolation gap 22 is preferably selected to be as large as possible given the space requirements of the insulation displacement contacts 20*a*, 20*b*. The length "X" of the isolation gap 22 is preferably selected to be as large as possible given the space constraints of the apparatus in which the connector block 100 is to be mounted. For example, where the mounting apparatus is a communications rack or a configuration of mounting bars.

Connector block 10, 100 includes apertures 50 to permit connection to a cable manager with fastening lugs (not shown). Connector block 10,100 also includes internal guides on its inner sidewalls (not shown) to facilitate connection to a cable manager with side clips.

It is to be appreciated that the embodiments of the invention described above with reference to the accompanying drawings have been given by way of example only and that modification and additional components may be provided to enhance the performance of the apparatus. In further embodiments of the present invention, a standard connector block 10, 100 with a regular spacing of insulation displacement contacts slots 16 (i.e. with no pre-formed isolation spacers 28, as shown in FIG. 1) may be used and the isolation gap 22 may be formed by leaving a selected number of slots between cable groups unconnected, wherein the selected number is selected to reduce alien crosstalk below a specified level. Preferably, the number of unconnected slots is sufficiently large to reduce alien crosstalk below levels required by the Category 6A standard.

In further embodiments of the present invention, the connector block 10, 100 is adapted to be mounted on vertical bars, in a rack or in a communications cabinet.

Advantageously, the twisted pairs may be terminated in the block by other forms of IDCs, including non-separable IDCs, and other forms of electrical contacts known in the art.

Throughout this specification and the claims which follow, unless the context requires otherwise, the word 'comprise,' and variations such as 'comprises' and 'comprising,' will be understood to imply the inclusion of a stated integer or step, or group of stated integers or steps.

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

The invention claimed is:

1. A termination block comprising:

a body having a top, a bottom, a front, a rear, a first side, and a second side, the body defining slot pairs extending in two rows along the front of the body between the first side and the second side, each slot pair including two slots having an open end at a front surface at the front of the body, each row of the slot pairs being separated into a first group of slot pairs at the first side of the body and a second group of slot pairs at the second side of the body, each group of the slot pairs including at least two of the slot pairs, the first group of each row being separated from the second group of the row by a gap that is larger than a gap between adjacent slot pairs within each group, the gap separating the first group from the second group being defined by the front surface of the body;

a plurality of pairs of insulation displacement contacts positioned at the slot pairs at the front of the body; and a first guide arrangement disposed at the rear of the housing, the first guide arrangement being configured to direct twisted pairs of electrical cables across the top of the body uncovered from the rear to the front.

2. The termination block of claim 1, wherein the first guide arrangement includes a plurality of first wire managers, each first wire manager being aligned with one of the groups of slot pairs in a first of the rows.

3. The termination block of claim 2, further comprising a second guide arrangement including a plurality of second wire managers each second wire manager being aligned with one of the groups of slot pairs in a second of the rows.

4. The termination block of claim 3, wherein the second wire managers extends outwardly from the bottom of the housing at the rear.

5. The termination block of claim 3, wherein each of the second wire managers is aligned with one of the first wire managers.

6. The termination block of claim 1, wherein each group of the slot pairs includes four slot pairs.

7. The termination block of claim 1, wherein the gap between adjacent slot pairs is larger than a gap between adjacent slots in each pair.

8. The termination block of claim 1, further comprising mounting members located at the rear of the body.

9. A termination block comprising:

a body having a top, a bottom, a front, a rear, a first side, and a second side, the body defining slot pairs extending in two rows along the front of the body between the first side and the second side, each slot pair including two slots having an open end at a front surface at the front of the body, each row of the slot pairs being separated into five groups of slot pairs at the front of the body, each group of the slot pairs including at least two of the slot pairs, each group being separated from an adjacent one of the groups of the respective row by a first gap that is larger than a second gap between adjacent slot pairs within each group, and the second gap being larger than a third gap between slots in each slot pair, each first gap being defined by the front surface of the body; and;

a plurality of pairs of insulation displacement contacts positioned at the slot pairs at the front of the body.

* * * * *